US011130644B2

(12) United States Patent
Liou

(10) Patent No.: US 11,130,644 B2
(45) Date of Patent: Sep. 28, 2021

(54) FEEDING APPARATUS

(71) Applicant: AVISION INC., Hsinchu (TW)

(72) Inventor: Te-Hsun Liou, Hsinchu (TW)

(73) Assignee: AVISION INC., Hsinchu (TW)

( * ) Notice: Subject to any disclaimer, the term of this patent is extended or adjusted under 35 U.S.C. 154(b) by 213 days.

(21) Appl. No.: 16/566,452

(22) Filed: Sep. 10, 2019

(65) Prior Publication Data

US 2020/0180883 A1 Jun. 11, 2020

(30) Foreign Application Priority Data

Dec. 11, 2018 (TW) ..... 107144461

(51) Int. Cl.
*B65H 3/52* (2006.01)
*B65H 3/56* (2006.01)

(52) U.S. Cl.
CPC ..... *B65H 3/5261* (2013.01); *B65H 3/56* (2013.01)

(58) Field of Classification Search
CPC ..... B65H 3/52; B65H 3/5253; B65H 3/5261
USPC ..... 271/121, 122, 125
See application file for complete search history.

(56) References Cited

U.S. PATENT DOCUMENTS

| | | | | |
|---|---|---|---|---|
| 8,459,635 | B2 * | 6/2013 | Inoue | B65H 3/0638 271/124 |
| 9,242,820 | B2 * | 1/2016 | Machii | B65H 3/0676 |
| 9,758,324 | B2 * | 9/2017 | Takase | B65H 3/0607 |
| 9,856,099 | B2 * | 1/2018 | Aoyama | B65H 3/5223 |
| 10,534,301 | B2 * | 1/2020 | Yuasa | B65H 1/266 |
| 2014/0197593 | A1 * | 7/2014 | Machii | B65H 3/66 271/121 |
| 2016/0159591 | A1 * | 6/2016 | Takase | B65H 3/56 271/121 |

FOREIGN PATENT DOCUMENTS

| | | | |
|---|---|---|---|
| JP | 2017141870 | A | 8/2017 |
| TW | 201221365 | A | 6/2012 |
| TW | M540746 | | 5/2017 |
| WO | 2017115877 | A1 | 6/2017 |
| WO | 2018209110 | A1 | 11/2018 |

* cited by examiner

*Primary Examiner* — Michael McCullough
(74) *Attorney, Agent, or Firm* — Maschoff Brennan

(57) ABSTRACT

The disclosure relates to a feeding apparatus capable of feeding media sheet. The feeding apparatus includes first feeding assembly comprising first mount frame, first roller and stopper. The stopper is pivotally connected to the first mount frame and movable with the first roller, the stopper has a covering portion configured to stop the media sheet, the first roller is located in the first mount frame and is movable along a straight path; while the stopper is pressing against the first roller and the first roller is moving along the straight path, the stopper is moved with the first roller so that the covering portion of the stopper is moved close to or away from the straight path.

10 Claims, 13 Drawing Sheets

FEEDING APPARATUS

CROSS-REFERENCE TO RELATED APPLICATIONS

This non-provisional application claims priority under 35 U.S.C. § 119(a) on Patent Application No(s). 107144461 filed in Taiwan, R.O.C. on Dec. 11, 2018, the entire contents of which are hereby incorporated by reference.

TECHNICAL FIELD

The disclosure relates to a feeding apparatus, more particularly to a feeding apparatus for sheet feeding.

BACKGROUND

Document processing equipment, such as scanners, printers, facsimile machines, and combination devices, generally have sheet feeders to pick a single media sheet to be processed from a stack of the media sheets.

SUMMARY

One embodiment of the disclosure provides a feeding apparatus configured to feed at least one media sheet. The feeding apparatus includes a first feeding assembly comprising a first mount frame, a first roller and a stopper. The stopper is pivotally connected to the first mount frame and is movable with the first roller, the stopper has a covering portion configured to stop the at least one media sheet, the first roller is located in the first mount frame and is movable along a straight path; while the stopper is pressing against the first roller and the first roller is moving along the straight path, the stopper is moved with the first roller so that the covering portion of the stopper is moved close to or away from the straight path.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Figure 1:
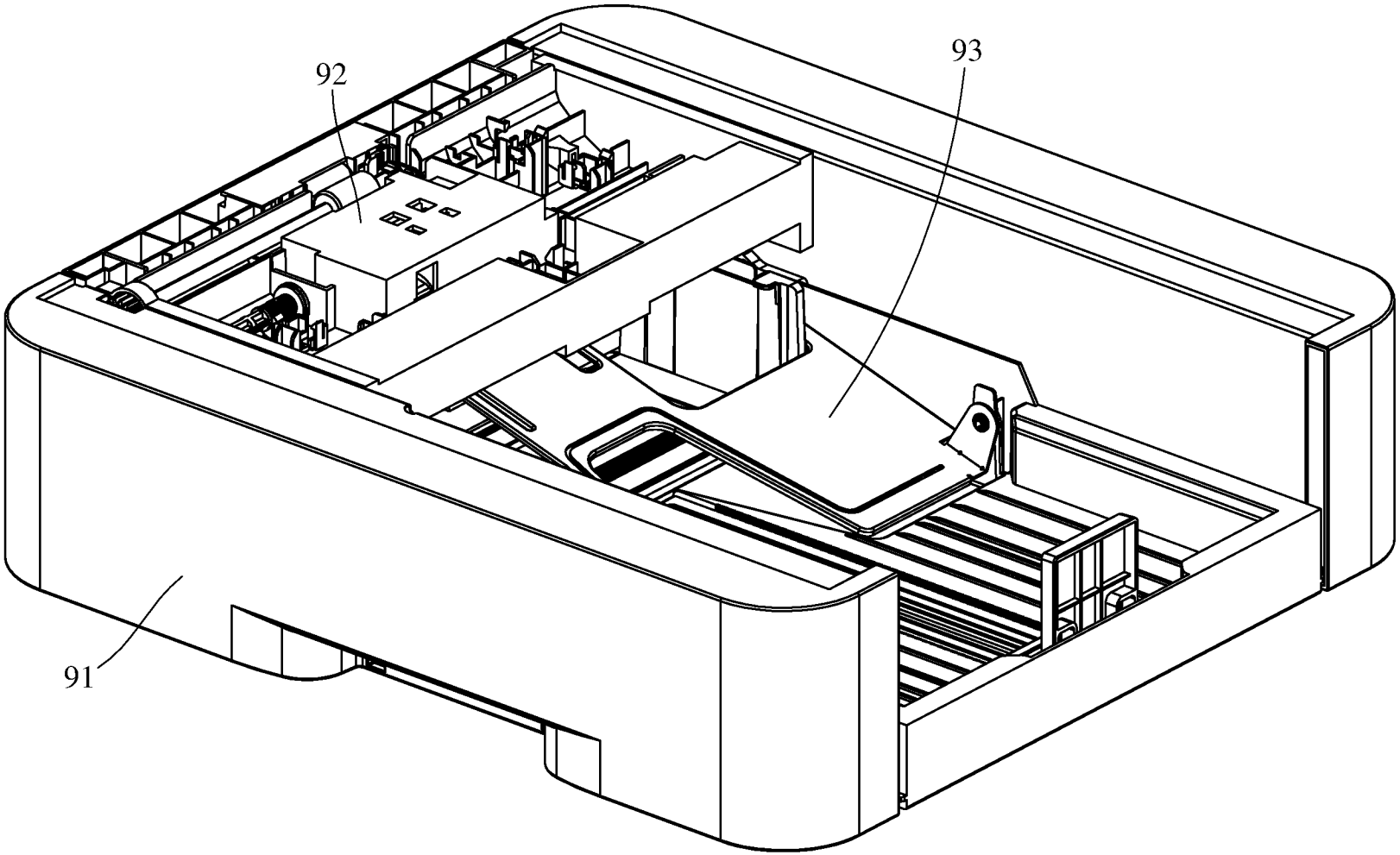
FIG. 1 is a perspective view of a feeding apparatus for a document processing equipment according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known main structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure. Furthermore, in order to simplify the drawings, some conventional structures and components are drawn in a simplified manner to keep the drawings clean.

Further, the following embodiments are disclosed by the figures, and some practical details are described in the following paragraphs, but the present disclosure is not limited thereto. Furthermore, for the purpose of illustration, some of the structures and components in the figures are simplified, and wires, lines or buses are omitted in some of the figures. And the size, ratio, and angle of the components in the drawings of the present disclosure may be exaggerated for illustrative purposes, but the present disclosure is not limited thereto, and various modifications are allowed and can be made according to the following disclosure as long as it does not depart from the spirit of the present disclosure. Note that the actual size and designs of the product manufactured based on the present disclosure may also be modified according to any actual requirements.

Further, the terms, such as "end", "portion", "part", "area" and the like may be used in the following to describe specific components and structures or specific features thereon or therebetween, but are not intended to limit these components and structures. In the following, it may use terms, such as "substantially", "approximately" or "about"; when these terms are used in combination with size, concentration, temperature or other physical or chemical properties or characteristics, they are used to express that, the deviation existing in the upper and/or lower limits of the range of these properties or characteristics or the acceptable tolerances caused by the manufacturing tolerances or analysis process, would still able to achieve the desired effect.

Furthermore, unless otherwise defined, all the terms used in the disclosure, including technical and scientific terms, have their ordinary meanings that can be understood by those skilled in the art. Moreover, the definitions of the above terms are to be interpreted as being consistent with the technical fields related to the disclosure. Unless specifically defined, these terms are not to be construed as too idealistic or formal meanings. The terms of the components in the disclosure are sometimes referred to in a more concise manner, depending on the requirements of the description, and should be understood by the reader.

Figure 2:
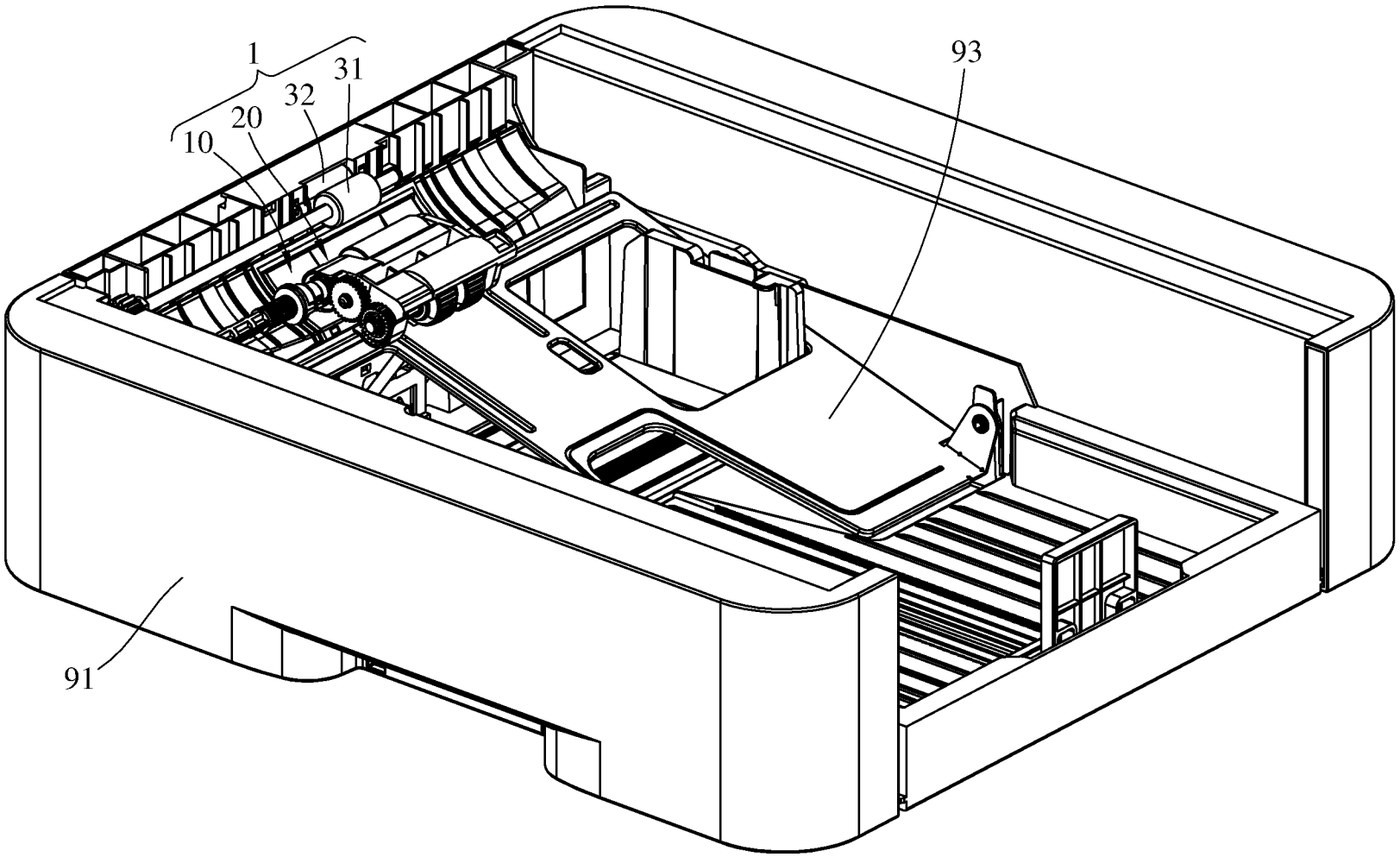
FIG. 2 is a perspective view of the feeding apparatus in FIG. 1 when an upper outer frame of the document processing equipment is removed.
Figure 12:
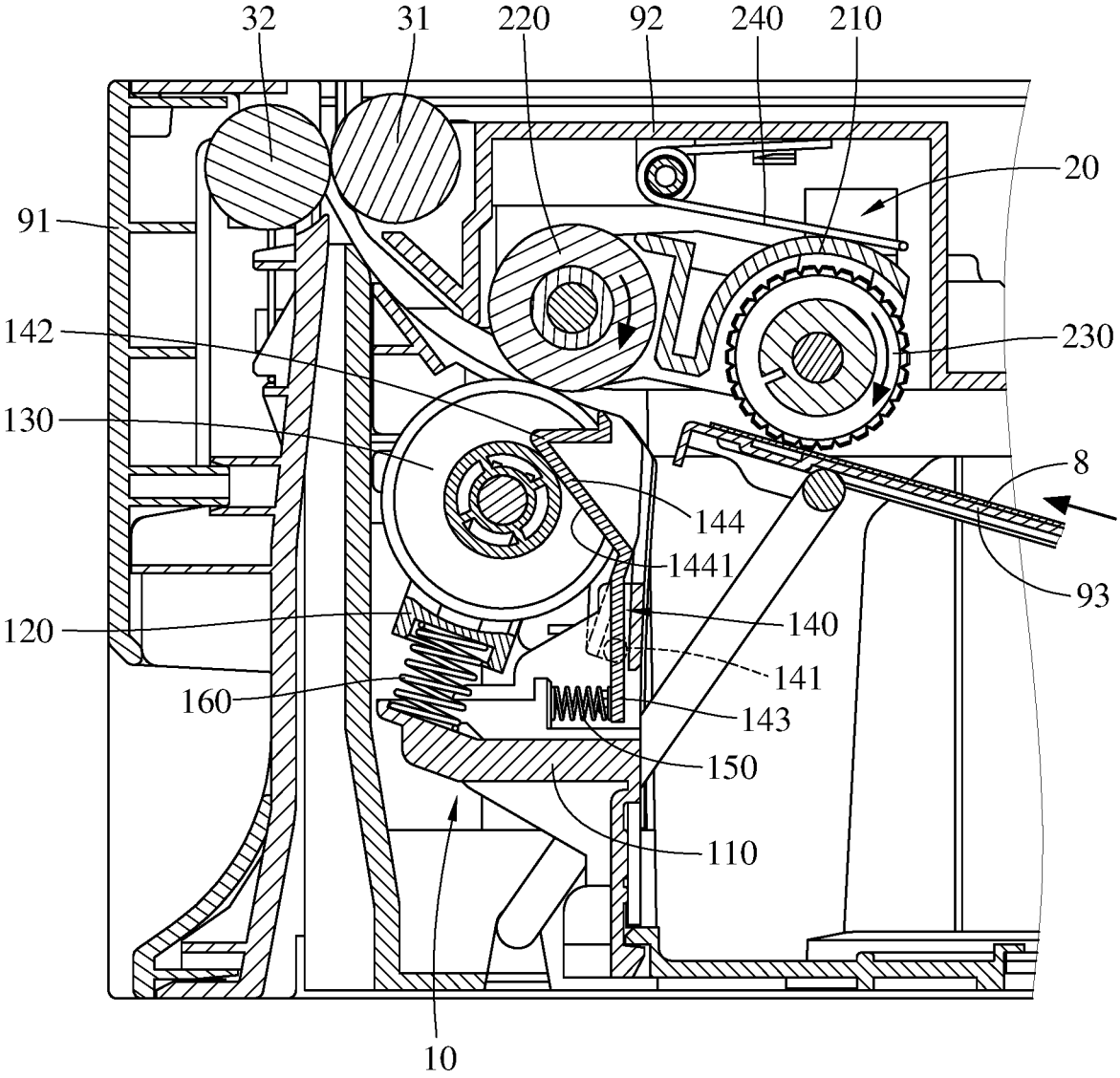
FIGS. 12 and 13 show the operation of the feeding apparatus in FIG. 1.
Figure 13:
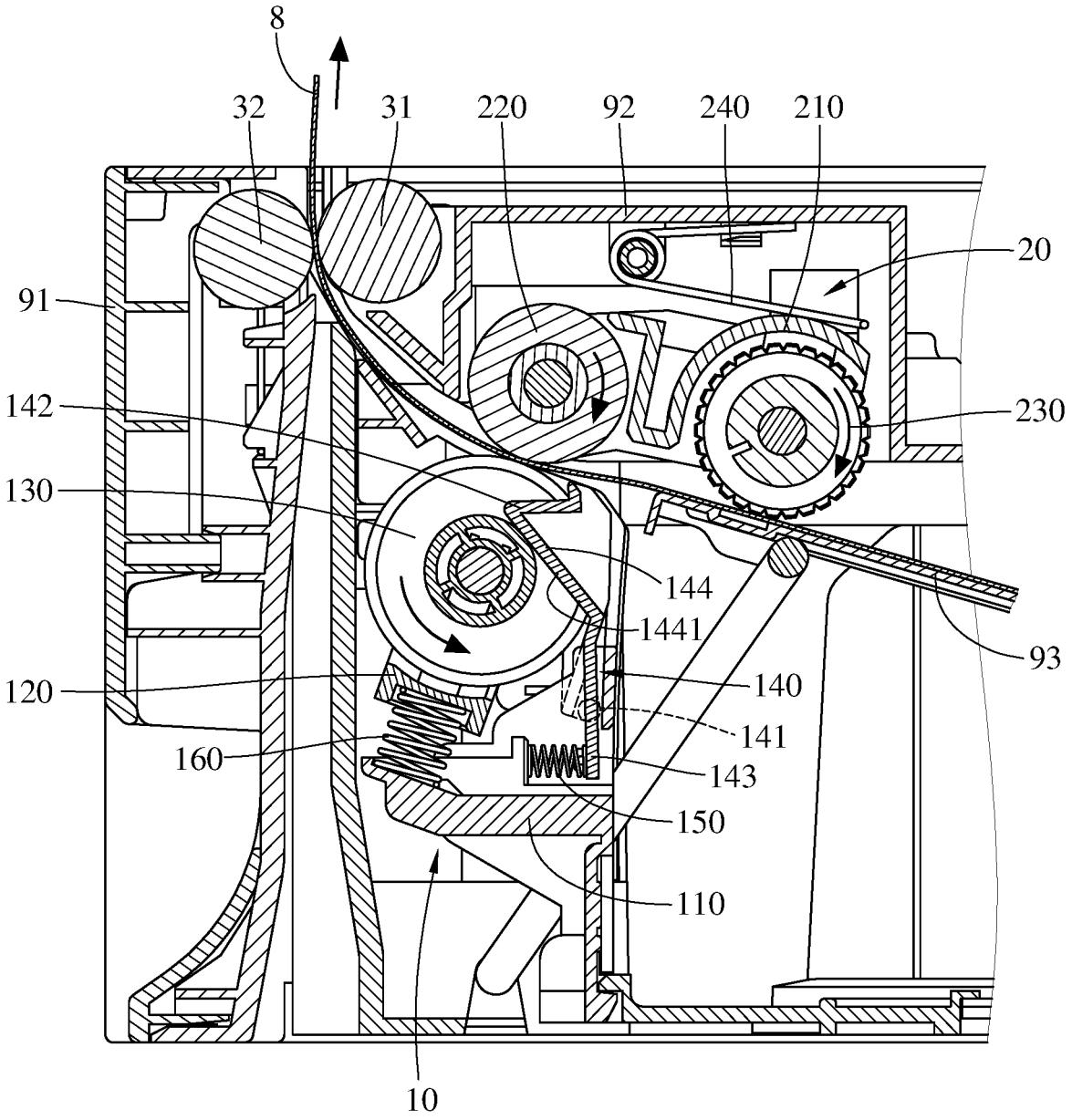

Firstly, please refer to FIGS. 1-2, FIG. 1 is a perspective view of a feeding apparatus for a document processing equipment according to one embodiment of the disclosure, and FIG. 2 is a perspective view of the feeding apparatus in FIG. 1 when an upper outer frame of the document processing equipment is removed. This embodiment provides a feeding apparatus 1 for a document processing equipment. The feeding apparatus 1 is adapted to be installed between a casing 91 and an upper outer frame 92 of the document processing equipment. There is a tray 93 on the casing 91, and the tray 93 is configured to load or support one or more media sheets 8 (as shown in FIG. 12 or FIG. 13) and is able to lift the media sheet 8 toward the feeding apparatus 1. In this embodiment, the feeding apparatus 1 is able to pick up the media sheet 8 on the tray 93 and transport it to other areas in the document processing equipment. The said media sheet 8 is a sheet object that can be transported into the document processing equipment and underwent a series of media processes. For example, the media sheet 8 may be paper, but the disclosure is not limited by the type, material, thickness or texture of the paper.

Figure 3:
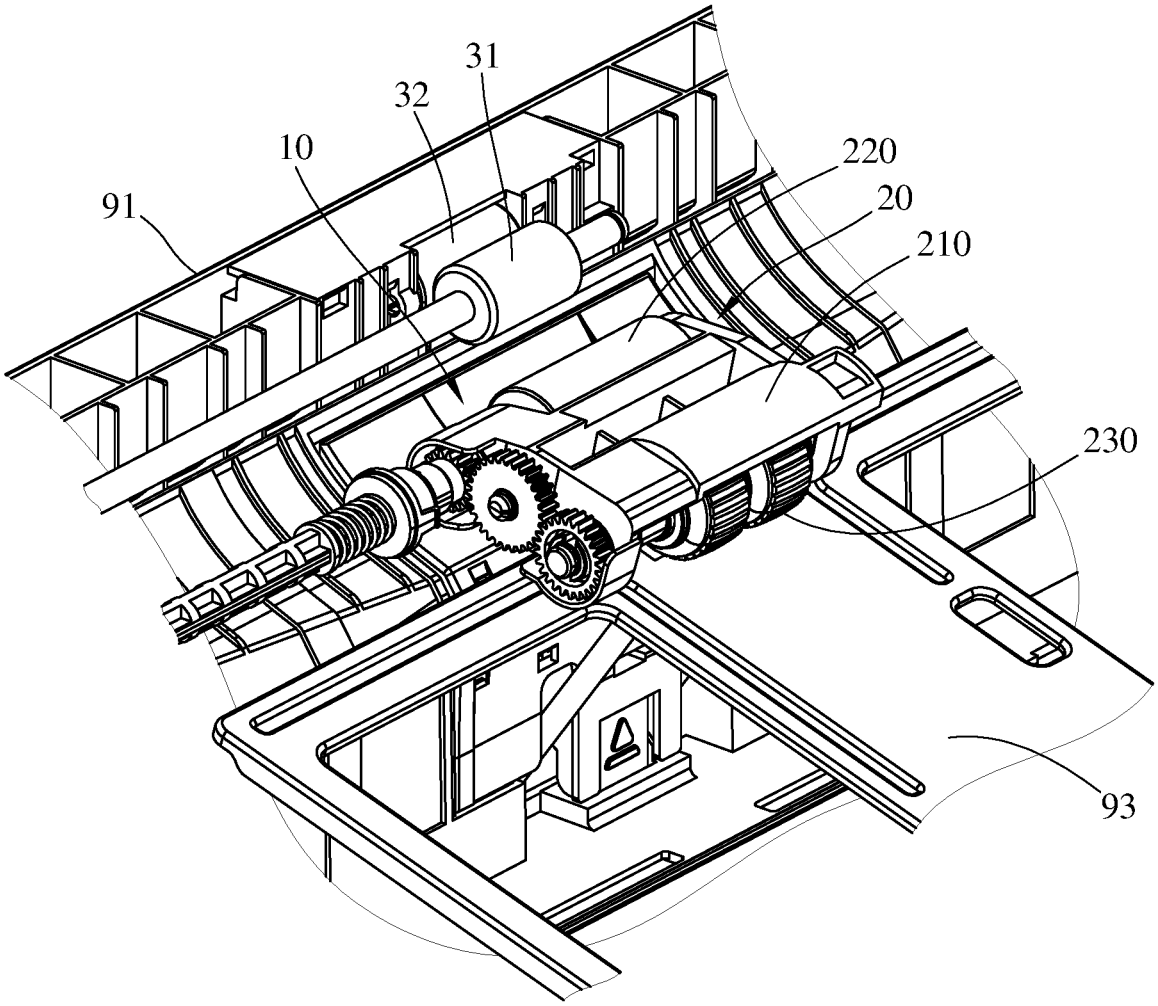
FIG. 3 is a partial enlarged view of the feeding apparatus in FIG. 2.
Figure 4:
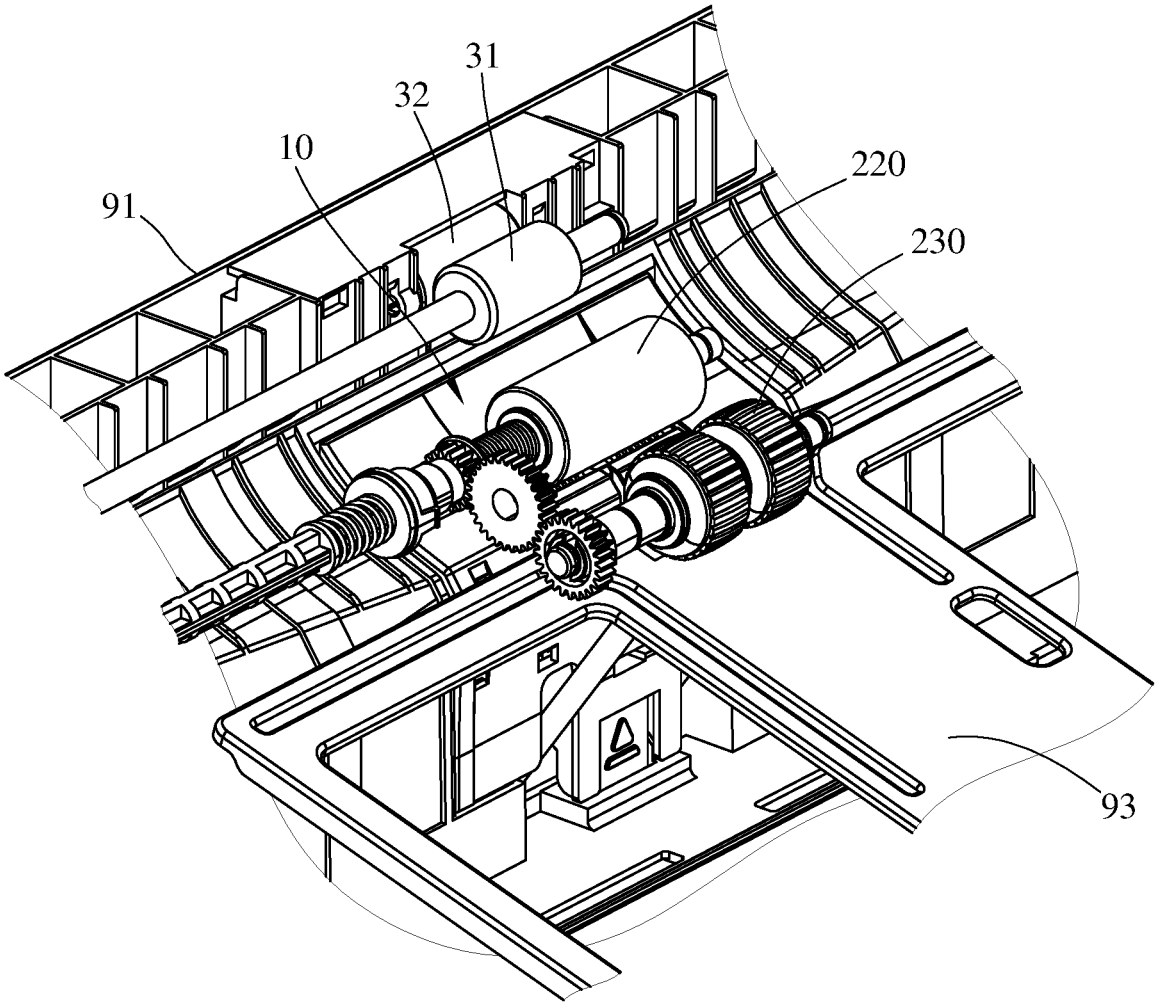
FIG. 4 is a perspective view of the feeding apparatus in FIG. 3 when a third mount frame is removed.
Figure 5:
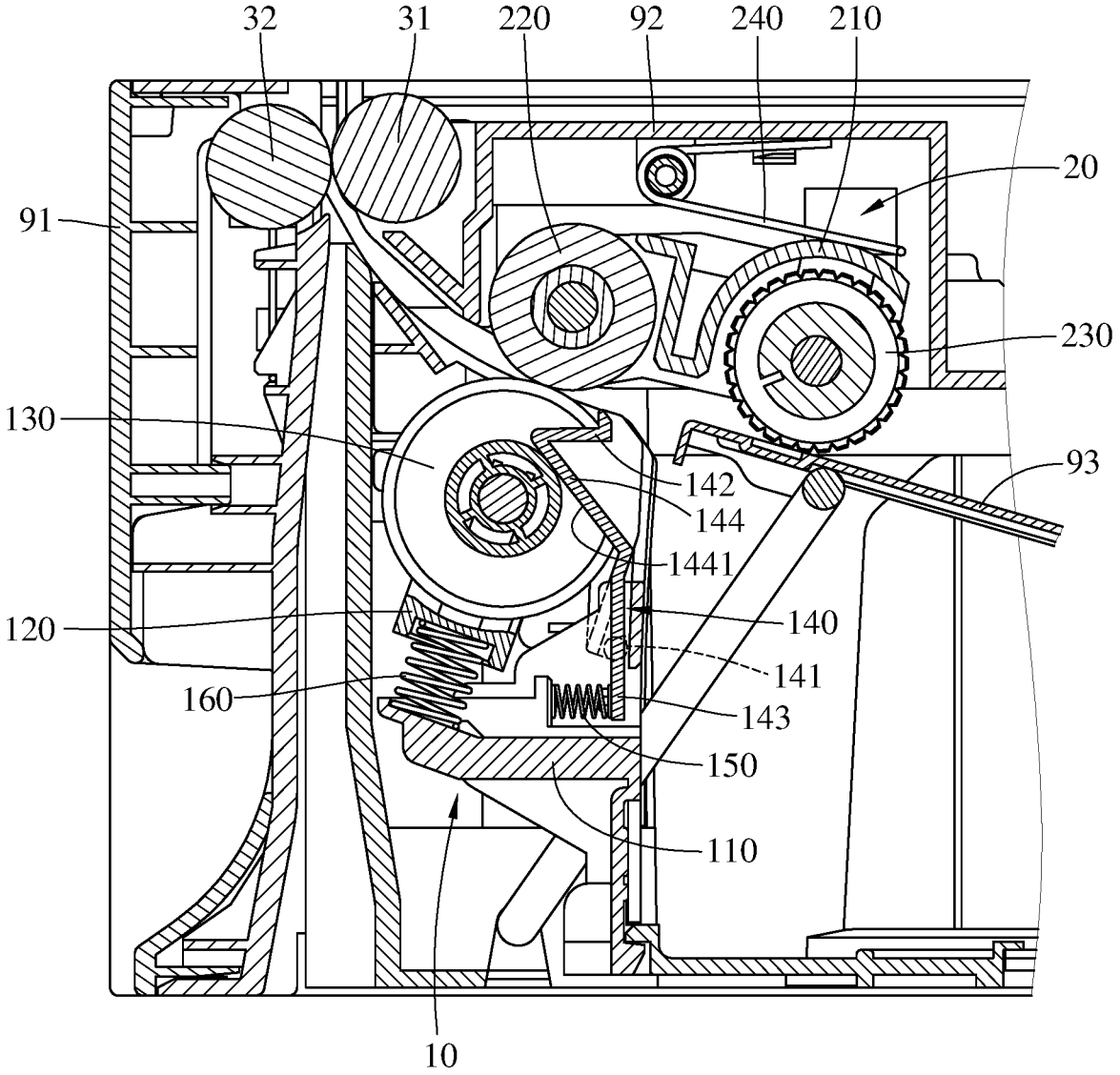
FIG. 5 is a partial enlarged side view of the feeding apparatus in FIG. 1.

Then, please refer to FIGS. 3-5, FIG. 3 is a partial enlarged view of the feeding apparatus 1 in FIG. 2, FIG. 4 is a perspective view of the feeding apparatus 1 in FIG. 3 when a third mount frame is removed, and FIG. 5 is a partial enlarged side view of the feeding apparatus 1 in FIG. 1. The overall configuration of feeding apparatus 1 can be seen in these figures. In this embodiment, the feeding apparatus 1 includes a first feeding assembly 10, a second feeding assembly 20, a first transfer roller 31 and a second transfer roller 32.

Figure 6:
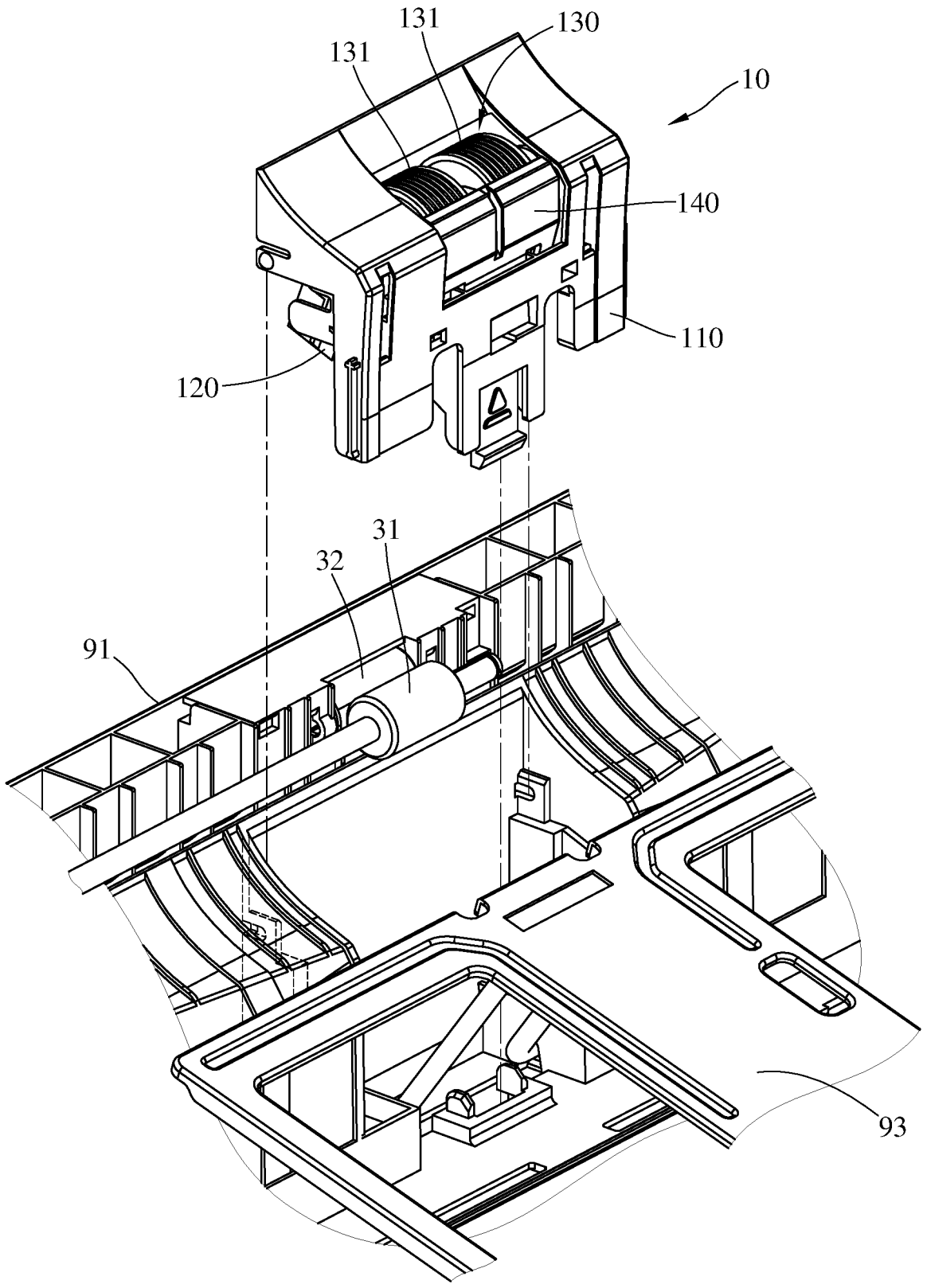
FIG. 6 is a perspective view of a first feeding assembly in FIG. 3 when being removed from a casing.
Figure 7:
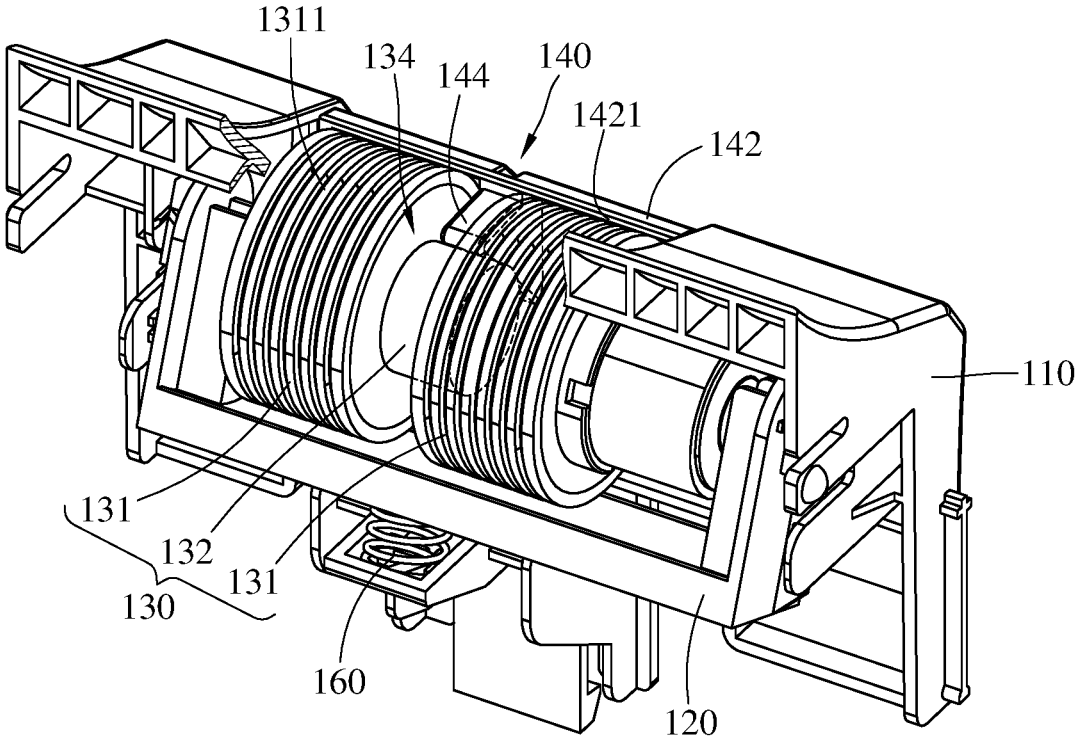
FIG. 7 is another perspective view of the first feeding assembly in FIG. 6.
Figure 8:
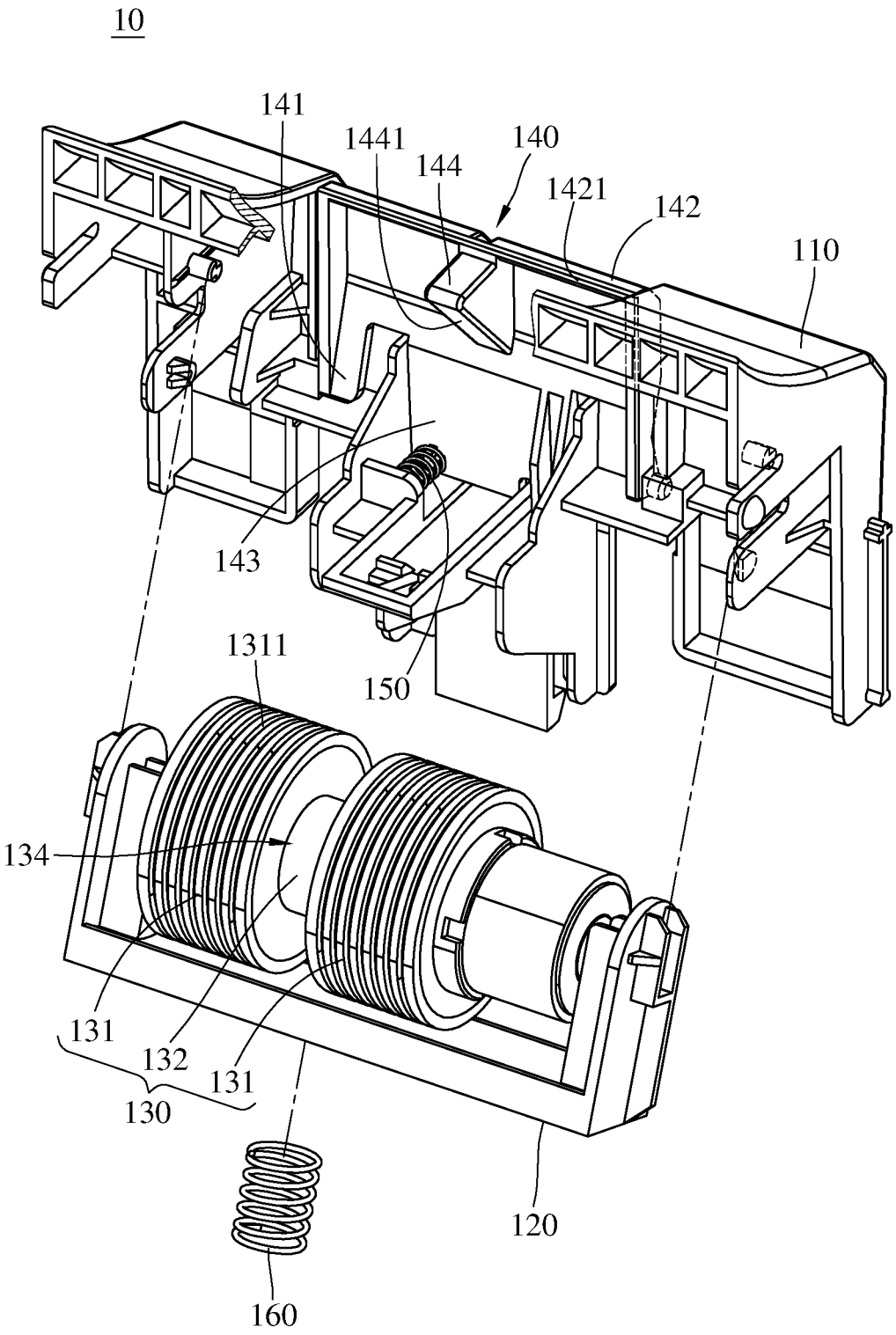
FIG. 8 is an exploded view of the first feeding assembly in FIG. 7.
Figure 9:
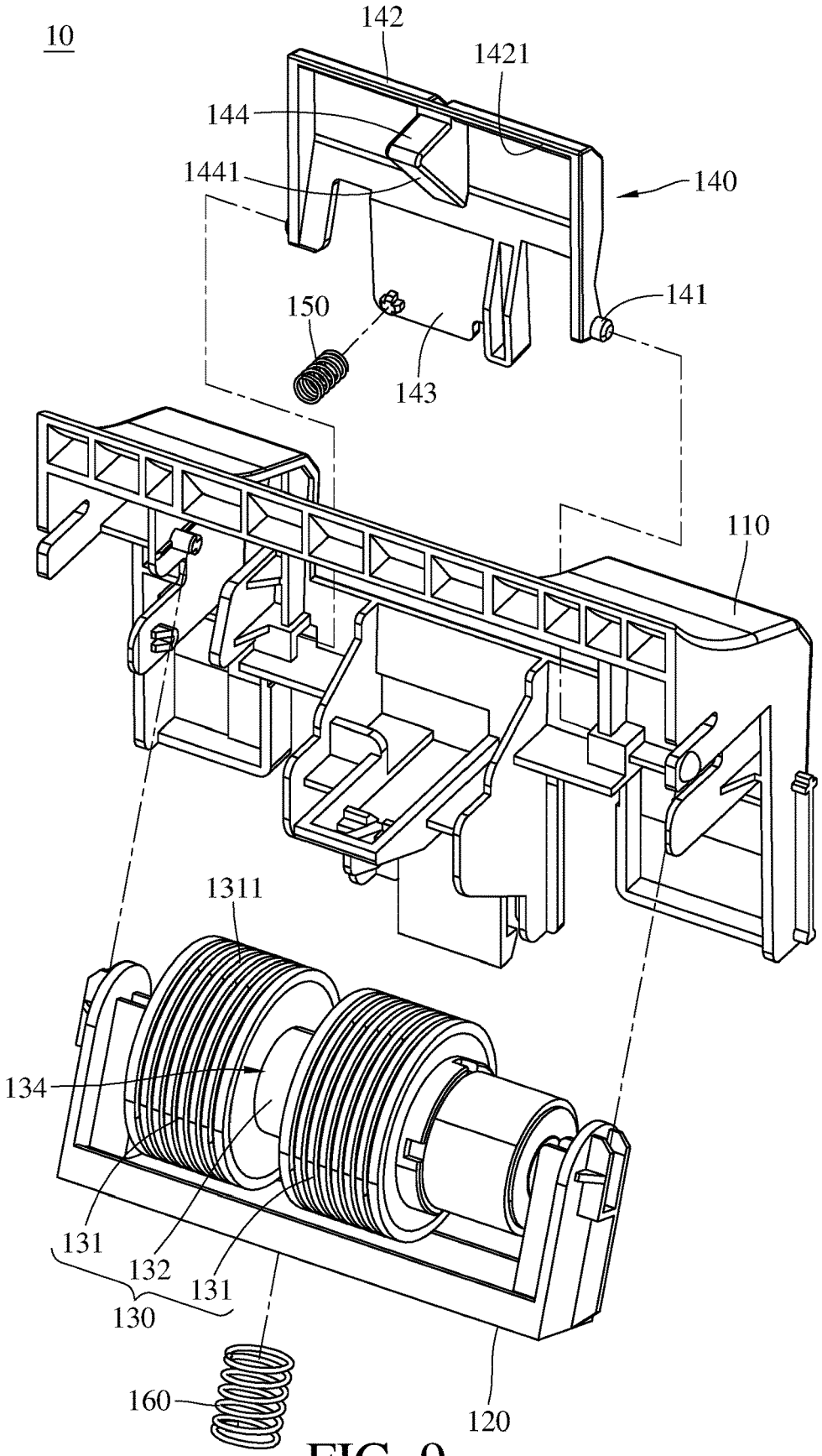
FIG. 9 is a detail exploded view of the first feeding assembly in FIG. 7.

Regarding the first feeding assembly 10, please refer to FIG. 5 and further refer to FIGS. 6-9, FIG. 6 is a perspective view of the first feeding assembly 10 in FIG. 3 when being removed from the casing 91, FIG. 7 is another perspective view of the first feeding assembly 10 in FIG. 6, FIG. 8 is an exploded view of the first feeding assembly 10 in FIG. 7, and FIG. 9 is a detail exploded view of the first feeding assembly 10 in FIG. 7.

The first feeding assembly 10 includes a first mount frame 110, a second mount frame 120, a first roller 130, a stopper 140, a first pressure applying component 150, and a second pressure applying component 160.

Figure 11:
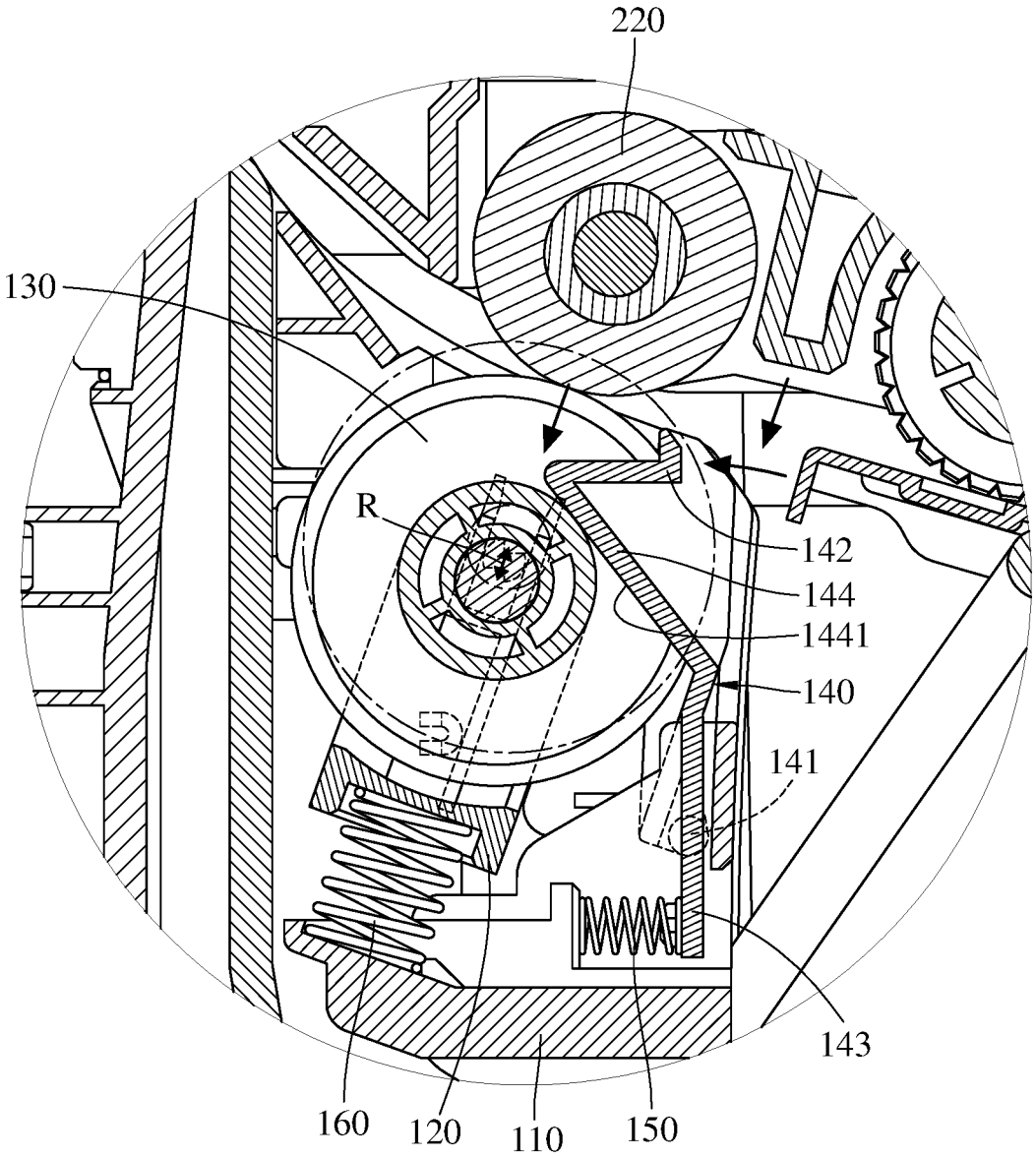
FIG. 11 is a partial enlarged side view of a second feeding assembly in FIG. 3 when the second feeding assembly is in an installation position.

The first mount frame 110 is detachably disposed on the casing 91, and the second mount frame 120 is slidably disposed on the first mount frame 110 so as to be slidable along a straight path R (as shown in FIG. 11). Therefore, the second mount frame 120 is able to be linearly moved with respect to the first mount frame 110 along the straight path R. The first roller 130 (also can be called "pressure roller") is rotatably mounted on the second mount frame 120. Therefore, the first roller 130 is able to be rotated with respect to the second mount frame 120. When the first roller 130 is rotated with respect to the second mount frame 120, and the second mount frame 120 is moved along the straight path R with respect to the first mount frame 110, the first roller 130 is doing a rotation and linear movements along the straight path R at the same time.

Further, in this embodiment, the first roller 130 includes two roller portions 131 and a bridge portion 132. The roller portions 131 are connected to each other via the bridge portion 132, and the roller portions 131 and the bridge portion 132 are coaxial. That is, the two roller portions 131 and the bridge portion 132 are able to be rotated with respect to the second mount frame 120 about the same axis. In more detail, a diameter of the roller portion 131 is larger than a diameter of the bridge portion 132, such that there is an annular groove 134 formed between the roller portions 131 and the bridge portion 132. In addition, each roller portion 131 has an outer surface 1311 configured to be in contact with the second feeding assembly 20. In this or other embodiments, the outer surface 1311 of the roller portion 131 may be made of a material that is soft and has a high coefficient of friction, such that the friction between the media sheet 8 and the first roller 130 is proper to transport the media sheet 8, but the disclosure is not limited by the configuration and material of the roller portion 131.

The stopper 140 is pivotally connected to the first mount frame 110 and is configured to stop or block the media sheet 8 and to cover part of the first rollers 130. In detail, in this embodiment, the stopper 140 has a pivot portion 141, a covering portion 142, a pressed portion 143, and a pressing portion 144. The stopper 140 is pivotally connected to the first mount frame 110 via the pivot portion 141. The covering portion 142 extends from a side of the pivot portion 141, and the pressed portion 143 extends from a side of the stopper 140 in a direction away from the covering portion 142. That is, the pressed portion 143 extends from a side of the pivot portion 141 away from the covering portion 142. Therefore, the covering portion 142 and the pressed portion 143 respectively extend from two opposite sides of the pivot portion 141. The covering portion 142 is located at a side of the first roller 130 and covers part of the first roller 130. Therefore, viewing from a specific direction, most portion of the first roller 130 is covered by the stopper 140 (i.e., the first roller 130 is partially exposed). This configuration allows the stopper 140 to stop or block the media sheet 8 that is not yet picked up and to prevent the media sheet 8 from hitting and damaging the first roller 130.

The pressing portion 144 is located at a side of the covering portion 142 facing the first roller 130 and protrudes toward and contacts the bridge portion 132 of the first roller 130. In more detail, in this embodiment, the first pressure applying component 150 is compressed between the pressed portion 143 of the stopper 140 and the first mount frame 110. The first pressure applying component 150 is, for example, a compression spring, and is able to press against the pressed portion 143 so as to force the covering portion 142 and the pressing portion 144 to move toward the first roller 130 and the straight path R, maintaining the pressing portion 144 to be in the annular groove 134 formed between the roller portions 131 and the bridge portion 132 and to be in contact with the bridge portion 132. In addition, a side of the pressing portion 144 facing the bridge portion 132 has an inclined contact surface 1441 configured to be in contact with the bridge portion 132. Further, the covering portion 142 has an inner surface 1421 facing the outer surfaces 1311 of the roller portions 131 of the first roller 130. In this embodiment, the inner surface 1421 of the covering portion 142 and the outer surfaces 1311 of the roller portions 131 of the first roller 130 are spaced apart by a gap, and the size of the gap is maintained to be a proper value that can prevent the media sheet from entering into the gap.

Furthermore, the second pressure applying component 160 is compressed between the second mount frame 120 and the first mount frame 110. In this embodiment, the second pressure applying component 160 is, for example, a compression spring, and is able to force the second mount frame 120 and the first roller 130 to move away from the first mount frame 110 along the straight path R. In other words, the second pressure applying component 160 is able to force the second mount frame 120 and the first roller 130 to move toward the second feeding assembly 20. Therefore, the second pressure applying component 160 increases the normal force between the first roller 130 of the first feeding assembly 10 and the second feeding assembly 20. Also, when the second mount frame 120 and the first roller 130 are moved along the straight path R by external force or the second pressure applying component 160, the first pressure applying component 150 will force the stopper 140 to move with the first roller 130, such that the pressing portion 144 will be moved close to or away from the straight path R and thus the inclined contact surface 1441 is kept contacting the bridge portion 132. That is, when the first roller 130 is rotated and/or linearly moved, the stopper 140 is moved with and always in contact with the first roller 130.

Figure 10:
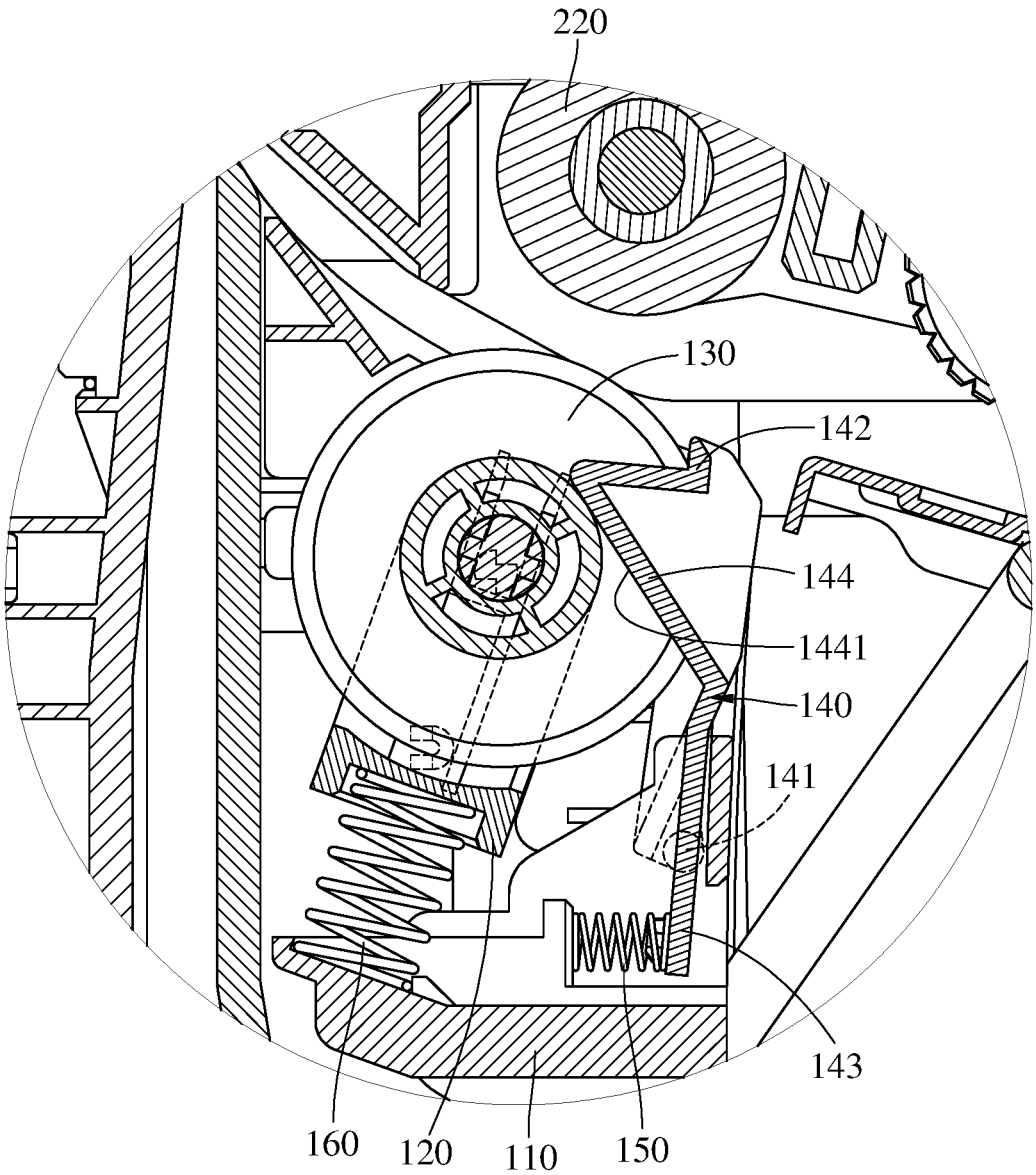
FIG. 10 is a partial enlarged side view of a second feeding assembly in FIG. 3 when the second feeding assembly is in a detached position.

Then, regarding the second feeding assembly 20, please refer back to FIGS. 3-5 and further refer to FIGS. 10-11, FIG. 10 is a partial enlarged side view of the second feeding assembly 20 in FIG. 3 when the second feeding assembly 20 is in a detached position, and FIG. 11 is a partial enlarged side view of the second feeding assembly 20 in FIG. 3 when the second feeding assembly is in an installation position. The second feeding assembly 20 is configured to be mounted on a side of the first feeding assembly 10. In detail, in this embodiment, the second feeding assembly 20 includes a third mount frame 210, a second roller 220, a third roller 230, and a third pressure applying component 240.

The third mount frame 210 may be but not limited to be part of the upper outer frame 92; alternatively, the third mount frame 210 may be a frame that is detachably mounted on the upper outer frame 92. The second roller 220 is rotatably connected to the third mount frame 210, and the second roller 220 and the third mount frame 210 are coaxial. In detail, the third mount frame 210 is pivotally disposed on the upper outer frame 92 so that it may be pivoted with respect to the second roller 220 by an external force; one end of the second roller 220 may be rotatably connected to the third mount frame 210, and another end of the second roller 220 may be connected to a drive shaft (not numbered). The drive shaft may be driven by a power source (not shown), such as a motor. Therefore, the second roller 220 is able to be rotated with respect to the third mount frame 210 by being driven by the drive shaft. As such, it is understood that the second roller 220 can be considered as to be a drive roller. In this embodiment, the second roller 220 presses against the first roller 130 of the first feeding assembly 10 so as to increase the normal force between the second roller 220 and the first roller 130, thereby increasing the friction between these rollers and the media sheet 8 and thus facilitating the feeding of the media sheet 8.

In detail, when the second feeding assembly 20 is installed, the predetermined location of the second roller 220 overlaps with the area for the first roller 130. In FIG. 10, the second feeding assembly 20 is not yet installed and is in a detached position; at this moment, the second roller 220 does not touch the first roller 130. Then, in FIG. 11, when the second feeding assembly 20 is installed so as to be in an installation position, the second roller 220 pushes the first roller 130 and forces the first roller 130 and the second mount frame 120 to move toward the first mount frame 110 along the straight path R, thereby increasing the normal force between the second roller 220 and the first roller 130.

In addition, during the installation of the second feeding assembly 20 as the processes shown from FIG. 10 to FIG. 11, the first roller 130 is moved downward by the second roller 220, but the stopper 140 is moved with the first roller 130. Therefore, the covering portion 142 of the stopper 140 is moved closer to the straight path R so as to maintain the size of the gap between the stopper 140 and the first roller 130. That is, the gap between the stopper 140 and the first roller 130 will not increase during the movement of the first roller 130 or the installation of the second feeding assembly 20. When the second feeding assembly 20 is in the installation position shown in FIG. 11, the first roller 130 is still able to be moved further away from the second roller 220, but the disclosure is not limited to the amount of distance that the first roller 130 is allowed to be moved away from the second roller 220.

The third roller 230 (may also be called a pickup roller) is rotatably mounted on the third mount frame 210 and is able to be rotated by the second roller 220. In detail, the third roller 230 may be connected to the second roller 220 via a gear set (not numbered) so that the third roller 230 is able to be rotated with respect to the third mount frame 210 by being driven by the second roller 220.

The third pressure applying component 240 is compressed between the third mount frame 210 and the upper outer frame 92; that is, the third pressure applying component 240 presses against a side of the third mount frame 210 facing away from the third roller 230. In this embodiment, the third pressure applying component 240 is, for example, a torsion spring, one end of the third pressure applying component 240 presses against the upper outer frame 92, another end of the third pressure applying component 240 presses against the third mount frame 210, Therefore, the third pressure applying component 240 is able to force the third roller 230 to pivot about the second roller 220. As shown in the figures, the third pressure applying component 240 is able to force the third mount frame 210 and the third roller 230 to pivot about the second roller 220 so as to move the third roller 230 toward the tray 93. When the tray 93 is loaded with the media sheet 8, the third roller 230 is able to press against and contact the media sheet 8 by being forced by the third pressure applying component 240, and the second roller 220 is able to drive the third roller 230 to rotate to pick up and advance the media sheet 8 to pass through the second roller 220 and the first roller 130.

The first transfer roller 31 and the second transfer roller 32 are located adjacent to each other and are respectively rotatably mounted on the upper outer frame 92 and the casing 91. The first transfer roller 31 and the second transfer roller 32 are configured to transport the media sheet 8 passing through the second roller 220 and the first roller 130. In addition, in this embodiment, the first transfer roller 31 is a drive roller, and the second transfer roller 32 is an idler roller and is movable close to or away from the first transfer roller 31, but the disclosure is not limited thereto. Any design that can transport the media sheet 8 to the predetermined area should belong to the scope of the disclosure. In some other embodiments, the feeding apparatus may not have the first transfer roller 31 and second transfer roller 32.

Then, please refer to FIGS. 12-13, FIGS. 12-13 show the feeding of the media sheet 8 using the feeding apparatus 1.

Firstly, before feeding the media sheet 8, one end of the tray 93 will be moved upward so that the media sheet 8 on the tray 93 will be moved closer to the third roller 230 of the second feeding assembly 20. And the third roller 230 will be in contact with the media sheet 8. At this moment, the third roller 230 can be rotated by being driven by the second roller 220 so as to pick up the media sheet 8 and send it toward the second roller 20 and the first roller 130 of the first feeding assembly 10. The stopper 140 is located between the first roller 130 and the tray 93, such that the stopper 140 is able to prevent the media sheet 8 from hitting the outer surfaces 1311 of the first roller 130 from undesired directions and to stop or block the other media sheet 8 that is not yet transported.

While the media sheet 8 is passing through between the second roller 20 and the first roller 130, the media sheet 8 causes the first roller 130 to rotate, and the first roller 130 may be slightly moved away from the second roller 220 along the straight path R due to the thickness of the media sheet 8, this movement of the first roller 130 is very small, but the stopper 140 is still able to be moved with the first roller 130 because the first pressure applying component 150 keeps pressing against the pressed portion 143 of the stopper 140 to force the covering portion 142 to move closer to the straight path R. Thus, the inclined contact surface 1441 of the pressing portion 144 is kept contacting the bridge portion 132 of the first roller 130 while the media sheet 8 is passing through between the second roller 20 and the first roller 130. That is, the gap between the inner surface 1421 of the covering portion 142 and the outer surfaces 1311 of the roller portions 131 of the first roller 130 will not increase during the feeding of the media sheet 8.

As such, due to the design that the stopper 140 can follow the movement of the first roller 130, whether while installing the second feeding assembly 20 or feeding of the media sheet 8, it is possible to prevent the second feeding assembly 20, the media sheet 8, and any external force from increasing the gap between the first roller 130 and the stopper 140, thereby preventing the media sheet 8 unexpectedly entering the gap between the first roller 130 and the stopper 140. As a result, paper jam is prevented.

Then, the first transfer roller 31 and the second transfer roller 32 are able to guide the media sheet 8 passing through the first roller 130 and the second roller 220 and transport it to other predetermined areas. Then, after the media sheet 8 exits the first roller 130, the first roller 130 is not pressed by the media sheet 8, and the second pressure applying component 160 will timely force the second mount frame 120 and the first roller 130 to move toward and contact the second roller 220 again.

According to the feeding apparatus as discussed above, the stopper is movable with the first roller, and the covering portion of the stopper is able to be moved close to or away from the straight path of the first roller, such that the size of the gap between the covering portion of the stopper and the first roller is always maintained in a proper value and does not increase whether while installing another feeding assembly or experiencing any external force. Therefore, it is possible to prevent the media sheet from directly hitting and damaging the first roller and to avoid the media sheet from unexpectedly entering the gap between the first roller and the stopper to cause paper jam.

In addition, since the size of the gap between the covering portion of the stopper and the first roller is always maintained in a proper value and does not increase, it is possible to have a larger size of the first roller to obtain a longer lifespan of the first roller.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A feeding apparatus, configured to feed at least one media sheet, comprising:

a first feeding assembly, comprising a first mount frame, a first roller and a stopper, wherein the stopper is pivotally connected to the first mount frame and is movable with the first roller, the stopper has a covering portion configured to stop the at least one media sheet, the first roller is located in the first mount frame and is movable along a straight path; while the stopper is pressing against the first roller and the first roller is moving along the straight path, the stopper is moved with the first roller so that the covering portion of the stopper is moved close to or away from the straight path.

2. The feeding apparatus according to claim 1, wherein the first feeding assembly further comprises a second mount frame, the second mount frame is slidably disposed on the first mount frame and is slidable along the straight path, and the first roller is rotatably connected to the second mount frame.

3. The feeding apparatus according to claim 2, wherein the first roller comprises at least one roller portion and a bridge portion that are connected to each other and are coaxial, a diameter of the at least one roller portion is larger than a diameter of the bridge portion, the stopper further has a pivot portion and a pressing portion, the pivot portion is pivotally connected to the first mount frame, the covering portion extends from a side of the pivot portion, the pressing portion is located at a side of the covering portion facing the first roller, extends toward the straight path, and contacts the bridge portion of the first roller.

4. The feeding apparatus according to claim 3, wherein the first feeding assembly further comprises a first pressure applying component, the stopper further has a pressed portion, the pressed portion extends from a side of the pivot portion in a direction away from the stopping portion, the first pressure applying component is compressed between the pressed portion and the first mount frame and presses against the pressed portion so as to force the pressing portion to move toward the bridge portion of the first roller and the straight path.

5. The feeding apparatus according to claim 2, wherein the first feeding assembly further comprises a second pressure applying component compressed between the second mount frame and the first mount frame, the second pressure applying component forces the second mount frame and the first roller to move away from the first mount frame along the straight path.

6. The feeding apparatus according to claim 1, further comprising a second feeding assembly located at a side of the first feeding assembly and configured to contact the first roller of the first feeding assembly along the straight path, wherein the second feeding assembly is configured to transport the at least one media sheet to pass through between the first roller and the second feeding assembly and to move the first roller and the stopper via the at least one media sheet.

7. The feeding apparatus according to claim 6, wherein the second feeding assembly comprises a third mount frame, a second roller and a third roller, the second roller is rotatably connected to the third mount frame, the second roller and the third mount frame are coaxial, the second roller is configured to contact the first roller of the first feeding assembly along the straight path, the third roller is rotatably disposed on the third mount frame and is connected to the second roller, the third roller is configured to pick up and transport the at least one media sheet through between the second roller and the first roller.

8. The feeding apparatus according to claim 7, wherein the second feeding assembly further comprises a third pressure applying component, the third pressure applying component presses against a side of the third mount frame facing away from the third roller so as to force the third roller to pivot about the second roller.

9. The feeding apparatus according to claim 7, wherein one of the second roller and the third roller is a drive roller.

10. The feeding apparatus according to claim 1, further comprising a first transfer roller and a second transfer roller that are adjacent to each other and located on a side of the first feeding assembly and the second feeding assembly, and the first transfer roller and the second transfer roller are configured to feed the at least one media sheet passing through the first feeding assembly and the second feeding assembly.

* * * * *